US006382688B1

(12) United States Patent
Agostini

(10) Patent No.: US 6,382,688 B1
(45) Date of Patent: May 7, 2002

(54) VEHICLE DOOR HANDLE

(75) Inventor: Astorre Agostini, Alpignano (IT)

(73) Assignee: Valeo Sicurezza Abitacolo S.p.A., Santena (IT)

( * ) Notice: Subject to any disclaimer, the term of this patent is extended or adjusted under 35 U.S.C. 154(b) by 0 days.

(21) Appl. No.: 09/566,951

(22) Filed: May 8, 2000

(30) Foreign Application Priority Data

May 7, 1999 (IT) ..... TO99A0381

(51) Int. Cl.[7] ..... E05B 3/00
(52) U.S. Cl. ..... 292/336.3; 292/347
(58) Field of Search ..... 292/216, 336.3, 292/347, 348, DIG. 22, DIG. 65

(56) References Cited

U.S. PATENT DOCUMENTS 3,453,015 A 7/1969 Miller
3,719,248 A 3/1973 Breitschwerdt et al.
5,669,642 A * 9/1997 Kang ..... 292/336.3
6,007,122 A * 12/1999 Linder et al. ..... 292/336.3
6,042,159 A * 3/2000 Spitzley et al. ..... 292/216

FOREIGN PATENT DOCUMENTS

DE 19825708 3/1999
WO 9633079 10/1996

* cited by examiner

*Primary Examiner*—Stephen Avila
(74) *Attorney, Agent, or Firm*—Liniak, Berenato, Longecre & White

(57) ABSTRACT

A vehicle door handle having a supporting structure connected to a door of a vehicle; a movable grip hinged to the supporting structure; and an inertial-mass safety device for preventing movement of the grip in the event of lateral impact on the vehicle. The device has a slide movable between a forward position retaining the grip and positively engaging a seat formed on the grip, and a withdrawn rest position permitting free movement of the grip; and an inertial mass separate from the slide and movable, in the event of lateral impact, to move the slide into the forward position.

12 Claims, 1 Drawing Sheet

VEHICLE DOOR HANDLE

The present invention relates to a vehicle door handle.

BACKGROUND OF THE INVENTION

Vehicle door handles are known comprising a connecting structure housed at least partly in the door, and a grip hinged to the connecting structure; and, to activate the door opening mechanism, the grip is pulled by the user to rotate it about its hinge axis.

The above grip movement, however, may at times be caused, not by the user voluntarily opening the vehicle door, but in response to impact on the side of the vehicle, thus accidentally opening the door and seriously endangering the safety of the driver and passengers.

Solutions are known in which accidental opening of the door is prevented by inertial masses inside the handle, and which act permanently on the grip in opposition to the opening force. Such masses, however, on the one hand, increase the inertia of the grip, thus making voluntary opening of the door by the user more difficult, and, on the other, have the drawback of keeping the distressed door closed, but not always those on the opposite side of the vehicle.

Moreover, known inertial masses are sized according to, and are only effective up to, a maximum predicted impact intensity, beyond which efficiency is gradually reduced. To increase efficiency, it is therefore necessary to act on the mass itself, which, over and above a given limit, however, would be excessively large and incompatible with the space available.

SUMMARY OF THE INVENTION

It is an object of the present invention to provide a handle designed to provide a straightforward, low-cost solution to the problems posed by the known state of the art.

According to the present invention, there is provided a vehicle door handle comprising a supporting structure connected to a door of a vehicle; a movable grip hinged to said supporting structure; and an inertial-mass safety device for preventing movement of said grip in the event of lateral impact on the vehicle; characterized in that said device comprises a slide movable between a forward retaining position positively engaging a seat formed in said grip, and a withdrawn rest position permitting free movement of the grip; and an inertial mass separate from the slide and movable, in the event of lateral impact, to move said slide into said forward position.

This therefore provides for obtaining a vehicle door handle, which prevents accidental opening of the door in the event of impact on the side of the vehicle, and which at the same time in no way affects normal voluntary opening of the door.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
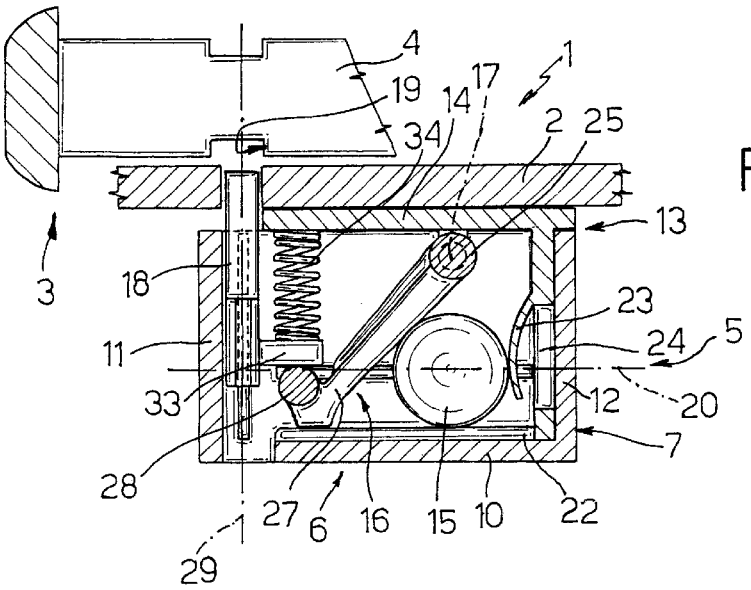
FIG. 1 shows a longitudinal section, with parts removed for clarity, of a preferred embodiment of the handle according to the present invention.

Number 1 in FIG. 1 indicates as a whole a vehicle door handle. Handle 1 comprises a supporting structure 2 (shown partly) housed at least partly in the door of the vehicle (not shown), and to which is hinged a grip 3 having an appendix 4 connected directly to a mechanism (not shown) controlling the respective lock. To structure 2 is also connected an inertial safety device 5, which comprises a parallelepiped-shaped structure 6 defined by a cup-shaped body 7 comprising two lateral walls 8, 9, a bottom wall 10, a front wall 11 and a rear wall 12, and is closed by an L-shaped body 13 having a wall 14 parallel to bottom wall 10. Cup-shaped body 7 houses a preferably spherical or cylindrical body 15; a lever 16 rotated about a hinge axis 17 by body 15; and a slide 18 connected to lever 16 and moved by lever 16 between a forward locking position engaging an outer lateral seat 19 in appendix 4, and a withdrawn rest position not engaging seat 19.

Figure 4:
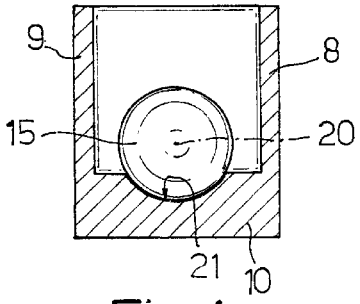
FIG. 4 shows the same view as, and a variation of a detail in, FIG. 3.
Figure 3:
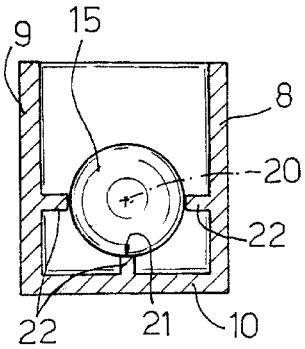
FIG. 3 shows a cross section of a detail in FIG. 1.

More specifically, body 15 is free to move along an axis 20, and is connected to cup-shaped body 7 by a guide 21 defined (FIG. 3) by three ribs 22 fixed respectively to lateral walls 8, 9 and bottom wall 10. Alternatively, as shown in FIG. 4, guide 21 is defined by a channel formed in bottom wall 10. When slide 18 is in the rest position, body 15 contacts both lever 16 and a flexible tongue 23, which is supported by a portion 24 of body 13 projecting from wall 14 and contacting rear wall 12.

Lever 16 comprises a pin 25 coaxial with axis 17 and fitted at both ends inside respective seats 26 formed in lateral walls 8 and 9; three arms 27 extending radially from pin 25; and a cylindrical body 28 fixed integrally to the free ends of arms 27 and parallel to pin 25.

Slide 18 moves between said positions along an axis 29 perpendicular to axes 17 and 20, and along a respective guide 30 adjacent to front wall 11.

Figure 2:
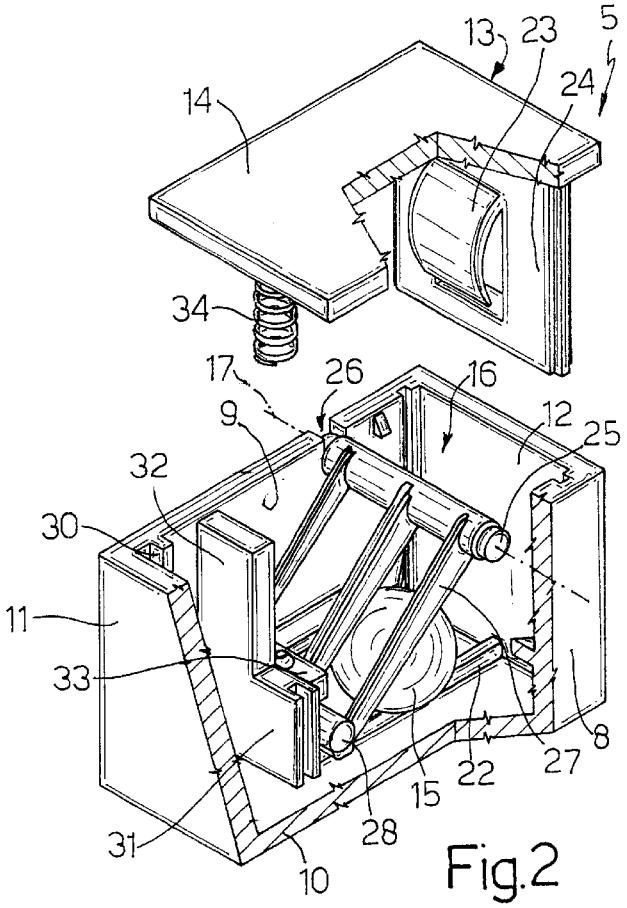
FIG. 2 shows an exploded view in perspective of an inertial assembly in FIG. 1.

As shown in FIG. 2, slide 18 comprises a first portion 31 extending between lateral walls 8 and 9, to which the first portion 31 is connected by guide 30; and a second portion 32 narrower than portion 31 and which engages seat 19 when the slide is in the forward locking position.

Slide 18 and lever 16 are connected by a contact element 33, which is fixed integrally to slide 18, rests on body 28 of lever 16, and is forced against body 28 by a spring 34 housed inside cup-shaped body 7 and forced between element 33 and wall 14.

In actual use, spring 34 keeps slide 18 in the withdrawn position and body 15 forced between lever 16 and tongue 23, which exerts on body 15 a force in opposition to spring 34, so that grip 3 can be operated by the user to release the lock.

In the event the vehicle fitted with the handle according to the invention is subjected to lateral impact, i.e. is struck side-on, the impact itself moves body 15 along axis 20 towards front wall 11, so that lever 16 rotates and, overcoming the resistance of spring 34, moves slide 18 into the forward locking position to prevent any movement of grip 3 and, hence, operation of the lock. Following impact, spring 34 restores element 33 and the component parts of safety device 5 to the original positions shown in FIG. 1.

The device described therefore provides for using the handle normally in the absence of lateral impact, and, in the event of lateral impact, for keeping all the side doors of the vehicle closed, regardless of which side of the vehicle is struck.

Moreover, unlike known solutions, body 15 defines an inertial mass which, not being called upon to directly balance the inertial forces acting on grip 3, need not be sized according to a given predicted degree of impact on the door.

Clearly, changes may be made to the handle as described herein without, however, departing from the scope of the accompanying Claims.

In particular, lever 16 may be formed otherwise than as described by way of example; spring 34 may be replaced with other types, e.g. a leaf spring; cup-shaped body 7 may be formed in one piece with structure 2 and be shaped otherwise than as shown; body 15 may be connected to cup-shaped body 7 otherwise than as shown; and, as opposed to engaging seat 19, slide 18, in the forward position, may simply rest against a shoulder on grip 3.

I claim:

1. A vehicle door handle (1) comprising a supporting structure (2) connected to a door of a vehicle; a grip (3) hinged to said supporting structure (2); and an inertial-mass safety device (5) for preventing movement of said grip (3) in the event of lateral impact on the vehicle; characterized in that said device (5) comprises a slide (18) movable between a forward retaining position resting against a shoulder (19) carried by said grip (3), and a withdrawn rest position permitting free movement of the grip (3); and an inertial mass (15) separate from the slide (18) and movable, in the event of lateral impact, to move said slide (18) into said forward position.

2. A handle as claimed in claim 1, characterized by comprising first elastic means (34) for keeping said slide (18) in said rest position.

3. A handle as claimed in claim 2, characterized by comprising second elastic means (23, 34) for keeping said mass (15) in a standby position.

4. A handle as claimed in claim 3, characterized in that said second elastic means comprise an elastic member (23) exerting a force in opposition to that exerted by said first elastic means (34).

5. A handle as claimed in claim 4, characterized in that said elastic member comprises a leaf spring (23).

6. A handle as claimed in claim 1, characterized in that said slide (18) is movable along a straight path (29).

7. A handle as claimed in claim 6, characterized by comprising guide means (21) for guiding said mass (15) in a straight direction (20) substantially perpendicular to said path (29).

8. A handle as claimed in claim 1, characterized in that said safety device (5) also comprises a lever (16) interposed between said slide (18) and said inertial mass (15).

9. A handle as claimed in claim 8, characterized in that said lever (16) rotates about a hinge axis (17); said mass (15) resting directly against said lever (16).

10. A handle as claimed in claim 8, characterized in that the lever (16) rests directly against said slide (18).

11. A handle as claimed in claim 7, characterized in that said hinge axis (17) extends perpendicularly to said path (29) and to the traveling direction (20) of said inertial mass (15).

12. A handle as claimed in claim 1, characterized in that said mass (15) is a revolving body rolling, in use, in contact with a respective guide (21).

* * * * *